United States Patent [19]

Inoue et al.

[11] 4,162,843

[45] Jul. 31, 1979

[54] COLOR ELECTROSTATIC COPYING MACHINE

[75] Inventors: Satoru Inoue; Masaakira Umehara; Kazuo Aramaki; Hideo Inuzuka; Kouji Yamanobe, all of Tokyo, Japan

[73] Assignee: Ricoh Company, Ltd., Tokyo, Japan

[21] Appl. No.: 855,926

[22] Filed: Nov. 30, 1977

[30] Foreign Application Priority Data

Dec. 14, 1976 [JP] Japan ..... 51-149345
Dec. 28, 1976 [JP] Japan ..... 51-157626

[51] Int. Cl.[2] ..... G03G 15/01
[52] U.S. Cl. ..... 355/4; 96/1.2; 355/3 TR
[58] Field of Search ..... 355/4, 16, 3 TR; 96/1.2

[56] References Cited

U.S. PATENT DOCUMENTS

| | | | |
|---|---|---|---|
| 2,986,466 | 5/1961 | Kaprelian | 355/4 X |
| 3,267,840 | 8/1966 | Honma et al. | 355/3 TR |
| 3,690,756 | 9/1972 | Smith | 355/4 |
| 3,966,199 | 6/1976 | Silverberg | 355/3 TR |
| 3,970,383 | 7/1976 | Honda et al. | 355/4 |

*Primary Examiner*—R. L. Moses
*Attorney, Agent, or Firm*—David G. Alexander

[57] ABSTRACT

Three primary color toner images are transferred successively onto a copy sheet from three photoconductive drums. The copy sheet is successively moved into engagement with the drums in register with the toner images by an endless belt. Various transfer charging means are provided to electrostatically adhere the copy sheet to the belt and counteract an adverse accumulation of charge on the copy sheet caused by accumulation of toner substance thereon during the three successive transfer operations.

13 Claims, 8 Drawing Figures

COLOR ELECTROSTATIC COPYING MACHINE

BACKGROUND OF THE INVENTION

The present invention relates to a color electrostatic copying machine. In one type of prior art color copying machine a photoconductive drum is radiated with a light image of an original document three times through primary color filters respectively. After each imaging operation a toner substance of the complementary primary color is applied to the drum to produce a toner image which is transferred to a copy sheet. The three toner images superimposed on each other on the copy sheet form a full color copy of the original document and are thermally or otherwise fixed to the copy sheet. In a variation of this process, electrostatic images are formed on the drum, transferred to the copy sheet, and the toner substances are applied to the copy sheet for development. Although satisfactory copies may be produced by such a process, the fact that the drum must be imaged and developed three times to produce one copy makes the process impractical for high speed color copying.

To increase the copying speed, an electrostatic copying machine has been developed which comprises three separate optical imaging systems and three photoconductive drums which are used for the three primary colors respectively. The three drums are imaged in one scan or pass of an original document and the toner images are successively transferred to a copy sheet carried into engagement with the drums by an endless belt.

Two problems have remained heretofore unsolved in such a high speed color copying machine. The first arises from the fact that a transfer charge of a polarity opposite to an electrostatic charge on the toner substances must be applied to the copy sheet to effect transfer of the toner images thereto. Although the first toner image is transferred effectively, the charge of the toner substance constituting the first toner image interferes with the transfer of the second toner image. The third transfer operation is even worse since the charge of the first two toner images interferes with the transfer of the third toner image. This problem is compounded by the discharge effect of the belt which occurs when the belt and copy sheet move out of engagement with the drums.

Another problem is that of maintaining the copy sheet in tight engagement with the belt throughout the three transfer operations. Slippage of the copy sheet on the belt will result in the toner image transfers being out of register.

The fact that the transfer efficiency progressively decreases for the second and third transfer operations adversely affects the color purity and resolution. The best copies are produced when the colored toner images are overlayed on each other on the copy sheet and thermally fixed in place. However, the reduction in transfer efficiency decreases the electrostatic adhesive force of the toner images to the copy sheet and allows the toner images to mix together or smear. These factors have heretofore been major deterents to the widespread commercial applicability and acceptance of this type of high speed color electrostatic copying machine.

SUMMARY OF THE INVENTION

The present invention overcomes the problem of the progressive degeneration of transfer efficiency by providing various transfer charging means adapted to counteract the adverse accumulation of charge on the copy sheet caused by accumulation of toner substance thereof during the three successive transfer operations. The copy sheet is tightly electrostatically adhered to the belt by means of applying an electrostatic charge to the belt prior to engagement of the copy sheet therewith.

It is an object of the present invention to provide a color electrostatic copying machine which provides high speed, high quality color copying.

It is another object of the present invention to provide means for tightly electrostatically adhering a copy sheet to a belt to ensure perfect register of color toner images transferred to the copy sheet from three respective photoconductive drums.

It is another object of the present invention to overcome the problem of degeneration of transfer efficiency due to adverse charge accumulation and substantially improve the clarity and resolution in color electrostatic copying.

It is another object of the present invention to provide a generally improved color electrostatic copying machine.

Other objects, together with the foregoing, are attained in the embodiments described in the following description and illustrated in the accompanying drawing.

DESCRIPTION OF THE PREFERRED EMBODIMENTS

While the color electrostatic copying machine of the invention is susceptible of numerous physical embodiments, depending upon the environment and requirements of use, substantial numbers of the herein shown and described embodiments have been made, tested and used, and all have performed in an eminently satisfactory manner.

Figure 1:
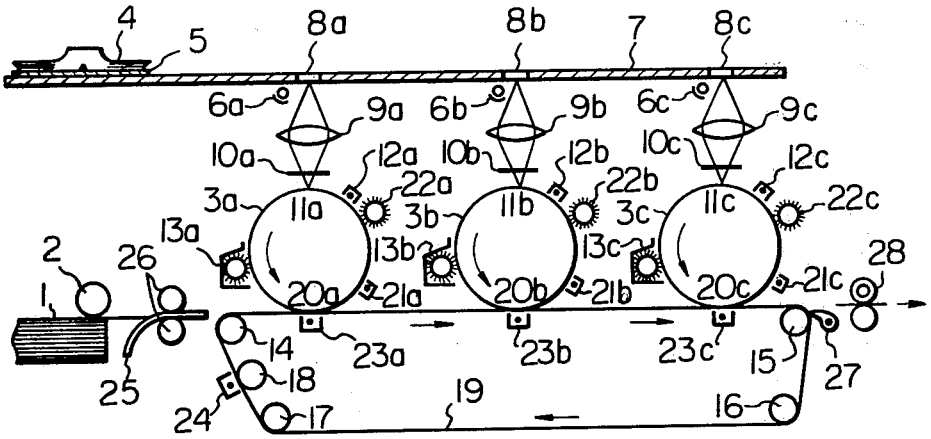
FIG. 1 is a schematic view of a first embodiment of an electrostatic copying machine of the present invention.

Referring now to FIG. 1 of the drawing, in a color electrostatic copying machine embodying the present invention copy sheets 1 are adapted to be fed by a feed roller 2 into successive engagement with first, second and third photoconductive drums 3*a*, 3*b* and 3*c* respectively which are rotated counterclockwise at constant speed. An original document here shown as a book 4 is supported by a glass platen 5 which is arranged to be moved rightwardly at the same surface speed as the drums 3*a* to 3*c*. Exposure slits or apertures 8*a*, 8*b* and 8*c* are formed through a horizontal upper support surface 7 of the copying machine through which the book 4 is illuminated by lamps 6a to 6c respectively disposed above the drums 3a to 3c. Optical systems symbolized by converging lenses 9a, 9b and 9c focus light images of the linear portions of the book 4 passing over the apertures 8a to 8c onto the drums 3a to 3c at exposure positions 11a, 11b and 11c respectively. Blue, green and red color filters 10a, 10b and 10c are provided in the optical paths of the lenses 9a to 9c respectively to radiate three primary color light images of the book 4 onto the drums 3a to 3c. Prior to imaging, the drums 3a to 3c are uniformly electrostatically charged by corona discharge units 12a, 12b and 12c. The light images cause localized photoconduction and the formation of electrostatic images on the drums 3a to 3c. During one rightward pass or scan of the book 4 over the apertures 8a to 8c the three electrostatic images are successively formed on the drums 3a to 3c.

Magnetic brush developing units 13a, 13b and 13c apply yellow, magenta and cyan toner or developing substances to the drums 3a to 3c to form three primary color toner images on the drums 3a to 3c respectively. An endless belt 19 is trained around rollers 14, 15, 16 and 17 and driven clockwise at the same surface speed as the drums 3a to 3c. A copy sheet 7 is fed from the feed roller 2 by means of pinch roller 26 over a guide plate 25 onto the belt 19 which carries the copy sheet 1 into successive engagement with the drums 3a to 3c. The timing of feeding the copy sheet 1 is synchronized so that the copy sheet 1 engages the drums 3a to 3c in register with the color toner images thereon. The copy sheet 2 engages the drums 3a to 3c at transfer positions 20a to 20c respectively. Subsequent to transfer, the electrostatic charges on the drums 3a to 3c are dissipated by discharge units 21a to 21c comprising corona discharge units and/or lamps. Any residual toner substances on the drums 3a to 3c are removed by cleaning units 22a to 22c.

In accordance with the present invention, transfer chargers 23a to 23c are disposed below the transfer positions 20a to 20c and apply electrostatic charges of the same polarity as the charging units 12a to 12c onto the copy sheet 1 through the belt 19. The belt 19 is preferably made of a dielectric material such as polyester or polypropylene. The magnitudes of the charges of the transfer chargers 23a to 23c are sufficiently higher than the magnitudes of the electrostatic potentials on the drums 3a to 3c to transfer the toner images to the copy sheet 1. The transfer chargers 23a to 23c charge the copy sheet 1 through the belt 19.

The developing units 13a to 13c comprise agitator means (not shown) which develop an electrostatic charge through dry friction on the toner substances of a polarity opposite to the polarity of the electrostatic images on the drums 3a to 3c. The toner substances comprise ferromagnetic carrier particles which form a magnetic brush and smaller, colored toner particles which adhere to the carrier particles due to electrostatic force. The toner particles adhere to the electrostatic images on the drums 3a to form the toner images while the carrier particles remain in the developing units 13a to 13c and are recycled.

The electrostatic charges on the toner particles are what cause the transfer process to progressively degenerate, since they are of the opposite polarity from the charges of the transfer chargers 23a to 23c. The toner image transferred from the drum 3a has charge which partially cancels the charge of the transfer charger 23b. The toner images from the drums 3a and 3b in combination partially cancel the charge of the transfer charger 23c, but to approximately twice the extent. This, in combination with the dielectric nature of the toner particles and the discharge effect of the belt 19 when the belt 19 disengages from the drums 3a to 3c causes the transfer efficiency to progressively degenerate for the second and third transfer operations.

This problem is overcome in accordance with the present invention by making the magnitudes of the charges applied by the transfer chargers 3a to 3c progressively greater. In other words, the electrostatic charge applied to the copy sheet 1 through the belt 19 by the transfer charger 23c is greater than the charge applied by the transfer charger 23b which is in turn greater than the charge applied by the transfer charger 23a. The amount by which the transfer charge is progressively increased is designed to exactly counteract the adverse effect of the charge accumulation of the toner images on the copy sheet 1.

In order to further increase the transfer efficiency, a discharge unit 24 is provided to at least partially discharge the belt 19 prior to engagement therewith by the copy sheet 1. It is not desirable to completely discharge the belt 19 since an electrostatic charge thereon will cause the copy sheet 1 to be electrostatically adhered thereto in a very firm manner. This prevents the copy sheet 1 from slipping on the belt 19 and ensures that the copy sheet 1 will be in perfect register with all three toner images during transfer.

Also shown in FIG. 1 are a separating pawl 27 to remove the copy sheet 1 from the belt 19 and a mixing unit comprising heated feed rollers 28 to fix the toner images to the copy sheet 1 through a combination of heat and pressure and provide a permanent hard copy. The progressively increasing transfer charge further ensures that underlying toner images will be strongly attracted to the copy sheet 1 and will not mix with overlying toner images. This preserves the stratified or layered configuration of the toner images and ensures maximum purity and resolution of the finished copy.

Figure 2:
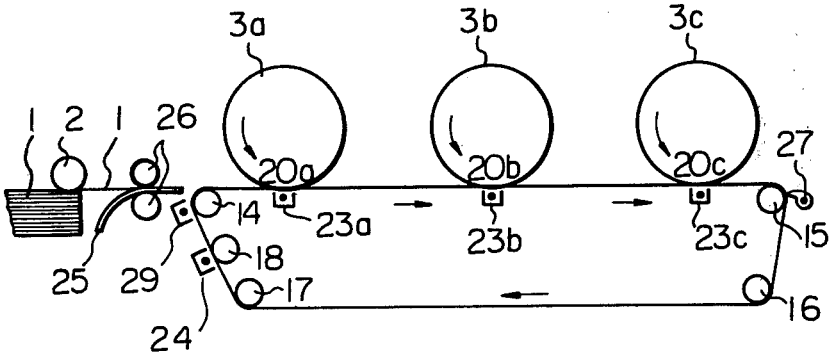
FIG. 2 similarly illustrates a modification of the first embodiment.

FIG. 2 illustrates an addition to the copying machine shown in FIG. 1. In all embodiments of the present invention illustrated herewith, like elements are designated by the same reference numerals. In FIG. 2, a primary charging unit 29 is provided to apply an electrostatic charge of the same polarity as the transfer chargers 23a to 23c onto the outer or copy sheet engaging surface of the belt 19. This serves not only to strongly attract and adhere the copy sheet 1 to the belt 19 but to reduce the magnitude of charge required to be applied to the belt 19 by the chargers 23a to 23c.

The performance of the embodiment of FIG. 1 is illustrated in examples 1 to 4 of table 1. Although the discharge unit 24 may produce a D.C. charge of a polarity opposite to the polarity of the transfer chargers 23a to 23c, the present invention is also adaptable to a configuration in which the discharge unit 24 applies an A.C. charge to the belt 18. In all examples in table 1, the discharge unit 24 is a corona discharge unit and an A.C. potential of 3.8 KV is applied thereto.

It will be noted that in example 1, with a D.C. potential of 4.0 KV applied to all of the chargers 23a to 23c the transfer ability or effect for all three colors is below 40%. Satisfactory transfer is produced at a transfer ability above 60%.

Table 1

| | Chargers | | | | | Transfer |
|---|---|---|---|---|---|---|
| | 24 (AC) | 29 (DC) | 23a (DC) | 23b (DC) | 23c (DC) | Ability |
| Ex. 1 | 3.8 KV | 0 KV | +4.0 KV | +4.0 KV | +4.0 KV | x |
| Ex. 2 | 3.8 | 0 | +5.0 | +5.0 | +5.0 | 1st Color o<br>2nd Color Δ<br>3rd Color x |
| Ex. 3 | 3.8 | 0 | +5.0 | +5.5 | +5.5 | 1st Color o<br>2nd Color o<br>3rd Color Δ |
| Ex. 4 | 3.8 | 0 | +5.0 | +6.0 | +7.5 | o |
| Ex. 5 | 3.8 | +3.0 | +4.0 | +4.0 | +4.0 | 1st Color o<br>2nd Color Δ<br>3rd Color x |
| Ex. 6 | 3.8 | +3.0 | +4.5 | +5.0 | +5.5 | 1st Color o<br>2nd Color Δ<br>3rd Color Δ |
| Ex. 7 | 3.8 | +4.0 | +4.0 | +5.0 | +6.0 | o |
| Ex. 8 | 3.8 | +4.0 | +4.5 | +5.5 | +6.5 | o |

Note:
The transfer ability was evaluated from measurement of toner image density.
o : transfer rate above 60%
Δ : transfer rate of 40–60%
x : transfer rate below 40%

In example 2, the potential applied to the three chargers 23a to 23c is increased to 5.0 KV. Although the transfer ability for the first color is satisfactory, the transfer abilities for the second and third colors are progressively more unsatisfactory.

In example 3, the potential applied to the transfer chargers 23b and 23c is increased to 5.5 KV. Whereas the first and second colors transfer satisfactorily, the transfer ability of the third color is still unsatisfactory.

In example 4, the potentials of the chargers 23b and 23c are increased to 6.0 KV and 7.5 KV respectively, resulting in completely satisfactory transfer ability and a perfect copy.

Examples 5 to 8 illustrate the effect of adding the primary charger 29 as shown in FIG. 2. Examples 5 and 6 show unsatisfactory cases where insufficient charge is applied to the belt by the various chargers. Examples 7 and 8 illustrate cases which produce completely satisfactory transfer ability. The advantage of adding the primary charger 29, in addition to ensuring strong adherence of the copy sheet 1 to the belt 19 and thereby perfect transfer register, becomes evident from comparing examples 7 and 8 with example 4. Where all of these exemplary cases produce satisfactory transfer ability, the potentials applied to the chargers 23a to 23c in examples 7 and 8 are substantially lower than the potentials applied in example 4. This reduces the size and cost of the power supply (not shown) for the chargers 23a to 23c and also the electric shock hazzard. In addition, fatigue of the drums 3a to 3c is reduced due to the lower transfer charge magnitude.

Figure 3:
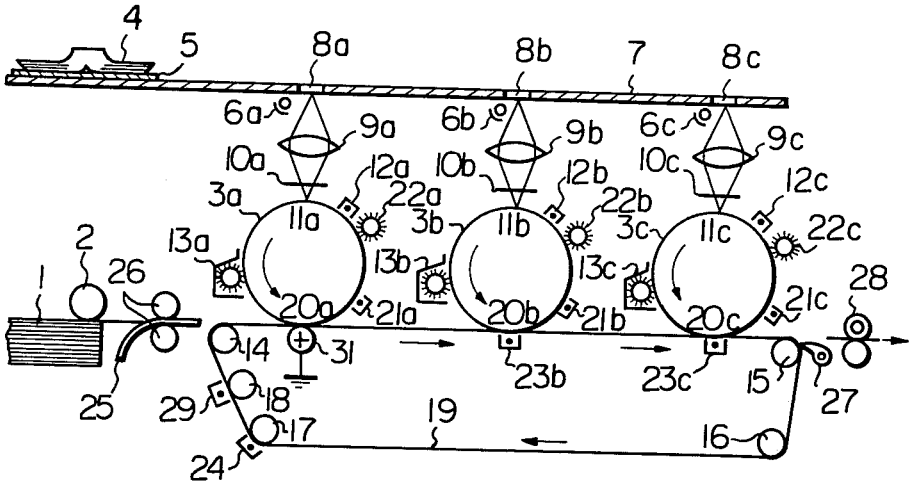
FIG. 3 shows a second embodiment of the present invention.

FIG. 3 illustrates a second embodiment of the present invention in which the charger 23a is replaced by a grounded roller 31 which lightly presses the copy sheet 1 through the belt 19 into engagement with the drum 3a. The roller 31 may be made or metal or electrically conductive rubber. The performance of the embodiment of FIG. 3 is illustrated in table 2, in comparison with various configurations of the embodiments of FIGS. 1 and 2. Examples 1 and 2 correspond to FIG. 1, examples 3 and 4 correspond to FIG. 2 and examples 5 and 6 correspond to FIG. 3. Example 5 teaches that satisfactory performance equivalent to that of example 3 may be obtained through the embodiment of example 5 but with lower potentials applied to the chargers 23b and 23c. Replacement of the charger 23a with the roller 31 reduces the cost and power requirements of the copying machine.

Figure 4:
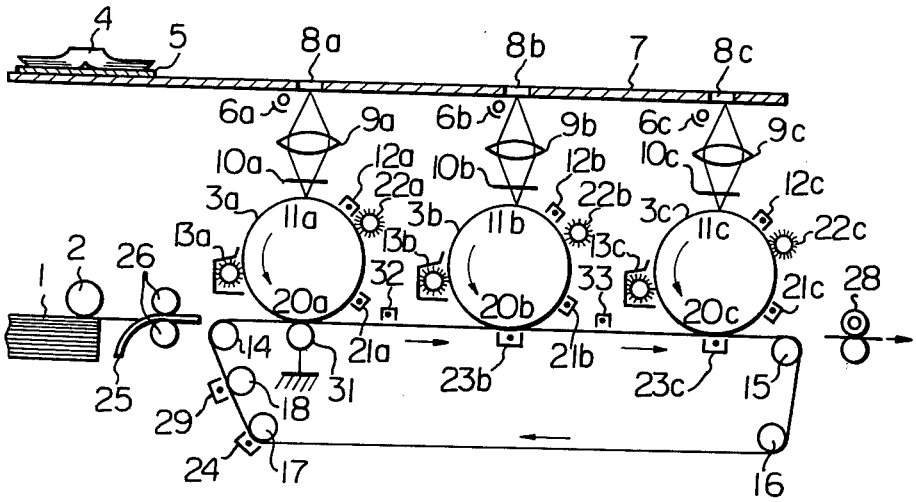
FIG. 4 shows a modification of the second embodiment.

FIG. 4 illustrates a modification of the embodiment of FIG. 3 in which transfer chargers 32 and 33 are provided between the drums 3a and 3b and between the drums 3b and 3c respectively. The chargers 32 and 33 apply charges of the same polarity as the chargers 23a to 23c to the copy sheet 1 and outer surface of the belt 19. These chargers 32 and 33 serve to neutralize the adverse charge of the toner images prior to subsequent transfer operations, and may be made large enough to reverse the charge on the toner particles and provide increased adhesion of the subsequent toner images. The potential applied to the chargers 23b and 23c may be substantially reduced, and the separating pawl 27 may become unnecessary. The chargers 32 and 33 further counteract the discharge effect of the belt 19 which occurs when the belt 19 and copy sheet 1 separate from the drums 3a to 3c.

Table 2

| | Charger | | | | | Transfer |
|---|---|---|---|---|---|---|
| | 24 (AC) | 29 (DC) | 23a (DC) | 23b (DC) | 23c (DC) | Ability |
| Ex. 1 | 3.8 KV | — | +5.0 KV | +5.0 KV | +5.0 KV | 1st Color o<br>2nd Color Δ<br>3rd Color x |
| Ex. 2 | 3.8 | — | +5.0 | +6.0 | +7.0 | All Colors o |
| Ex. 3 | 3.8 | +4.0 KV | +4.0 | +5.0 | +6.0 | All Colors o |
| Ex. 4 | 3.8 | 4.0 | +3.0 | +4.0 | +5.0 | All Colors Δ |
| Ex. 5 | 3.8 | 4.0 | Roller 31 | +4.0 | +5.0 | All Colors o |
| | | | Roller | | | |

Table 2-continued

| | Charger | | | | | Transfer |
|---|---|---|---|---|---|---|
| | 24 (AC) | 29 (DC) | 23a (DC) | 23b (DC) | 23c (DC) | Ability |
| Ex. 6 | 3.8 | +3.0 | 31 | +5.0 | +6.0 | All Colors o |

Note:
The transfer ability was evaluated from measurement of toner image density.
o : transfer rate above 60%
Δ : transfer rate of 40–60%
x : transfer rate below 40%

Figure 5:
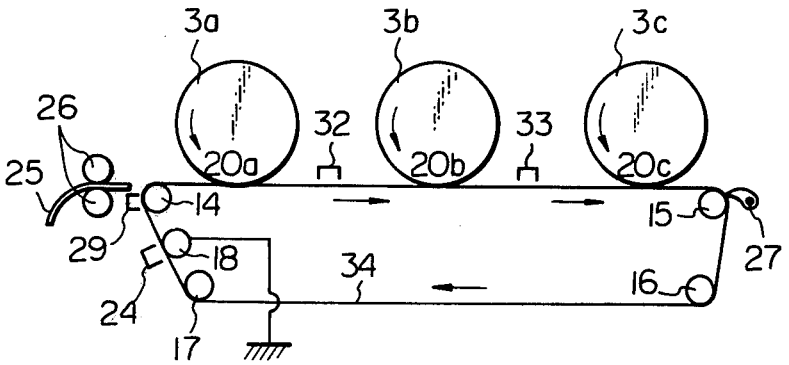
FIG. 5 shows a third embodiment of the present invention.
Figure 6:
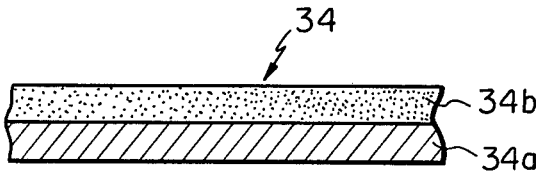
FIG. 6 is a fragmentary cross-sectional view of an endless belt of the embodiment of FIG. 5.

FIG. 5 illustrates a third embodiment of the present invention in which the dielectric belt 18 is replaced by a belt 34 having a cross section shown in FIG. 6. The belt 34 has an inner conductive layer 34*a* which is grounded through the roller 18 and an outer dielectric layer 34*b*. The belt 34 may be made by providing the layer 34*a* in the form of an aluminum substrate and coating polyester or polypropylene resin thereon to form the layer 34*b*. Alternatively, the layer 34*b* may constitute the substrate in the form of a dielectric sheet and the layer 34*a* formed thereon by metallic evaporation techniques or the like.

The embodiment of FIG. 5 allows the transfer chargers 23*a* to 23*c* to be eliminated, thereby reducing the complexity and cost of the copying machine. A potential of 4.0–6.5 KV applied to the charger 29 is sufficient to ensure good adhesion of the copy sheet 1 to the belt 34 and efficient transfer of all color toner images.

Figure 7:
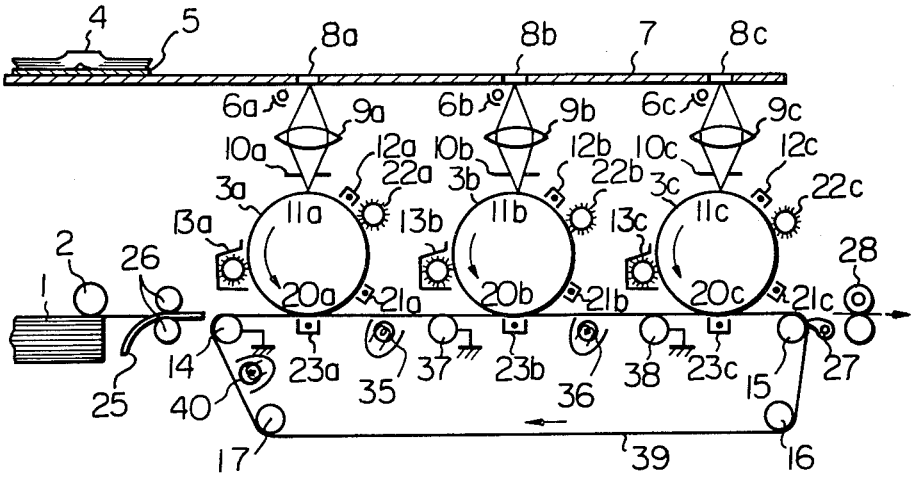
FIG. 7 shows a fourth embodiment of the present invention.

FIG. 7 illustrates a fourth embodiment of the invention in which the dielectric belt 19 is replaced by a photoconductive belt 39. A light source 35 is provided between the drum 3*a* and the drum 3*b*. Another light source 36 is provided between the drums 3*b* and 3*c*. A grounded roller 37 is provided between the light source 35 and the drum 3*b*. Another grounded roller 38 is provided between the light source 36 and the drum 3*c*. Yet another light source 40 is provided between the rollers 17 and 14. The rollers 37 and 38 engage the belt 39.

The light source 40 serves to uniformly illuminate the belt 39 and discharge the same through the roller 14, which is grounded, prior to engagement by the copy sheet 1. After transfer of the first toner image by the drum 3*a*, the light source 35 and roller 37 again discharge the belt 39 and the first toner image on the copy sheet 1, thereby eliminating the adverse charge of the first toner image. The light source 36 and roller 38 perform the same function after transfer of the second toner image by the drum 3*b*. The light sources 40, 35 and 36 may be fluorescent lamps or the like. This embodiment also allows the potentials applied to the chargers 23*a* to 23*c* to be substantially reduced.

Figure 8:
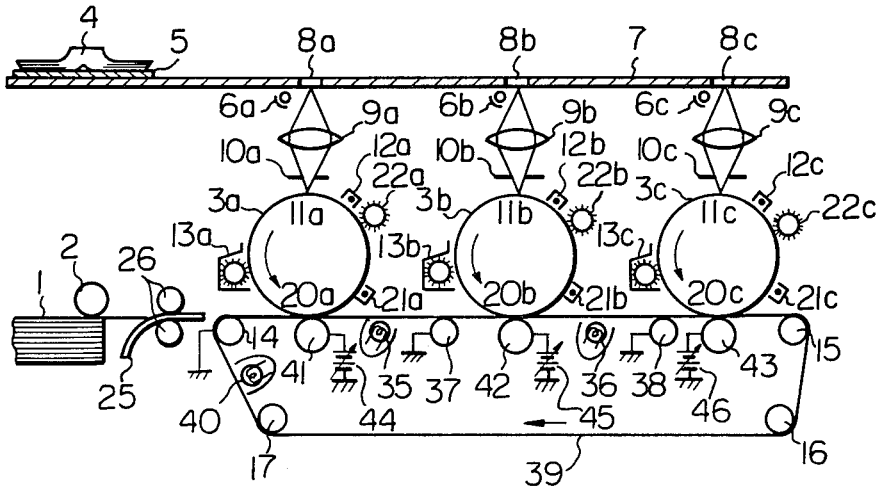
FIG. 8 shows a modification of the fourth embodiment.

FIG. 8 illustrates a modification of the embodiment of FIG. 7 in which the transfer chargers 23*a* to 23*c* are replaced by biased rollers 41, 42 and 43 respectively which lightly urge the copy sheet 1 into engagement with the drums 3*a* to 3*c* through the belt 39. Bias voltage sources 44, 45 and 46 apply optimally adjustable transfer bias potentials which are generally above 100 V to the rollers 41 to 43 respectively to provide the same effect as the transfer chargers 23*a* to 23*c*.

The advantages of the embodiments of FIGS. 7 and 8 will become apparent from the results of the following experiments.

EXAMPLE 1 (Prior Art)

A dielectric belt similar to the belt 19 formed of a 125 M thick polyethylene terephtalate sheet was rotated at a surface speed of 100 mm/sec and a toner image was transferred to a copy sheet conveyed thereon utilizing a transfer potential of 5.5 KV applied to a corona charging unit which applied a transfer charge to the copy sheet through the belt. After the transfer operation, a potential of −1500 V caused by adverse toner charge and discharge of the belt was measured on the belt. Subsequent toner image transfers were progressively more unsatisfactory.

EXAMPLE 2 (FIG. 7 Embodiment)

The photoconductive belt 39 was manufactured by dissolving 100 g of polyvinyl carbazol, 20 g of trinitrofluorenone and 100 g of polyester resin in 200 g of tetrahydrofuran and pouring the mixture onto a glass sheet to form a coating 100 M thick. After hardening, the coating was removed from the glass sheet and opposite ends thereof adhered together to form an endless belt. A potential of 5.5 KV was applied to all of the transfer chargers 23*a* to 23*c*. Due to the photoconductive effect of the lamps 40, 35 and 36 on the belt 39, a transfer ability of about 60% was measured for all three color toner image transfers.

EXAMPLE 3 (FIG. 7 Embodiment)

The same transfer conditions of example 2 were provided. However, in this case the photoconductive belt 39 was formed of a mixture of 20 g ZnO, 100 g of polyester resin and 200 g of tetrahydrofuran. A transfer ability essentially similar to that in example 2 was measured.

In summary, it will be seen that the present invention provides an improved electrostatic copying machine in which the problems of poor toner image register, purity and resolution are eliminated. Naturally, the principles of the present invention are applicable to a color electrostatic copying in which a fourth drum is provided to transfer a monochrome toner image in addition to the three primary color toner images. Other modifications will become possible for those skilled in the art after receiving the teachings of the present disclosure without departing from the scope thereof.

What is claimed is:

1. A color electrostatic copying machine comprising:
first, second and third photoconductive drums;
imaging means for radiating three light images of an original document in three primary colors onto the first, second and third drums to form three respective electrostatic images;
developing means for applying three toner substances of three primary colors to the first, second and third drums to develop the three electrostatic images and produce three primary color images respectively;
an endless belt for conveying a copy sheet into successive engagement with the first, second and third drums in register with the three color toner images respectively;

transfer charging means for applying an electrostatic charge to the belt of a first polarity which is opposite to a second polarity of the toner substances to successively transfer the three color toner images to the copy sheet; and compensation means for counteracting an accumulation of charge of the second polarity on the copy sheet due to accumulation of toner substance thereon.

2. A copying machine as in claim 1, in which the transfer charging means and compensation means are integral and comprise three transfer chargers disposed adjacent to the first, second and third drums for applying electrostatic charges of the first polarity to the copy sheet through the belt of progressively higher magnitudes respectively.

3. A copying machine as in claim 1, in which the transfer charging means comprises a primary transfer charger for applying an electrostatic charge of the first polarity onto a copy sheet engaging surface of the belt prior to engagement thereof with the copy sheet.

4. A copying machine as in claim 3, in which the transfer charging means further comprises a discharger for at least partially discharging the belt prior to charging by the primary transfer charger.

5. A copying machine as in claim 3, in which the transfer charging means and compensation means are integral and comprise a conductive, grounded roller pressing the copy sheet through the belt lightly against the first drum; and first and second transfer chargers disposed adjacent to the second and third drums for applying electrostatic charges of the first polarity to the copy sheet through the belt of progressively higher magnitudes respectively.

6. A copying machine as in claim 1, in which the belt is formed of a dielectric material.

7. A color electrostatic copying machine comprising:

first, second and third photoconductive drums;

imaging means for radiating three light images of an original document in three primary colors onto the first, second and third drums to form three respective electrostatic images;

developing means for applying three toner substances of three primary colors to the first, second and third drums to develop the three electrostatic images and produce three primary color images respectively;

an endless belt for conveying a copy sheet into successive engagement with the first, second and third drums in register with the three color toner images respectively;

transfer charging means for applying an electrostatic charge to the belt of a first polarity which is opposite to a second polarity of the toner substances to successively transfer the three color toner images to the copy sheet; and compensation means for counteracting an accumulation of charge of the second polarity on the copy sheet due to accumulation of toner substance thereon;

the compensation means comprising a first transfer charger disposed between the first and second drums and a second transfer charger disposed between the second and third drums to apply electrostatic charges of the first polarity to the copy sheet and belt.

8. A copying machine as in claim 7, in which the belt is formed of an inner, conductive grounded layer and an outer, dielectric copy sheet engaging layer.

9. A color electrostatic copying machine comprising:

first, second and third photoconductive drums;

imaging means for radiating three light images of an original document in three primary colors onto the first, second and third drums to form three respective electrostatic images;

developing means for applying three toner substances of three primary colors to the first, second and third drums to develop the three electrostatic images and produce three primary color images respectively;

an endless belt for conveying a copy sheet into successive engagement with the first, second and third drums in register with the three color toner images respectively;

transfer charging means for applying an electrostatic charge to the belt of a first polarity which is opposite to a second polarity of the toner substances to successively transfer the three color toner images to the copy sheet; and compensation means for counteracting an accumulation of charge of the second polarity on the copy sheet due to accumulation of toner substance thereon;

the belt being formed of a photoconductive material.

10. A copying machine as in claim 9, in which the transfer charging means comprises three transfer chargers disposed adjacent to the first, second and third drums for applying electrostatic charges of the first polarity to the copy sheet through the belt, the compensation means comprising a first light source disposed between the first and second drums and a second light source disposed between the second and third drums for uniformly radiating adjacent portions of the belt with light and discharging said adjacent portions respectively.

11. A copying machine as in claim 10, further comprising first and second grounded rollers engaging the belt between the first light source and the second drum and between the second light source and the third drum respectively.

12. A copying machine as in claim 10, in which the three transfer chargers are constituted by three corona discharge units respectively.

13. A copying machine as in claim 10, in which the three transfer chargers are constituted by three electrically biased rollers respectively which engage the belt.

* * * * *